United States Patent [19]

Meek

[11] 4,300,382

[45] Nov. 17, 1981

[54] AUTOMOBILE BODY DENT PULLER

[76] Inventor: James S. Meek, 3303 Lockwood Dr., Chattanooga, Tenn. 37415

[21] Appl. No.: 150,160

[22] Filed: May 15, 1980

[51] Int. Cl.[3] ..... B21D 1/12

[52] U.S. Cl. ..... 72/478; 72/479; 72/482; 72/705; 294/97

[58] Field of Search ..... 294/86 R, 97; 72/478, 72/480, 482, 705, 479, 458; 113/116 C

[56] References Cited

U.S. PATENT DOCUMENTS

| | | | |
|---|---|---|---|
| 288,467 | 11/1883 | McGuiggan | 294/97 |
| 764,281 | 7/1904 | Duncan | 294/97 |
| 1,788,151 | 1/1931 | Danzig | 113/116 C |
| 1,882,985 | 10/1932 | Schroeder | 294/97 |
| 3,091,983 | 6/1963 | Kliss | 72/458 |
| 3,577,881 | 5/1971 | Markovics | 72/705 |
| 3,844,149 | 10/1974 | Hansen | 72/125 |
| 4,040,287 | 8/1977 | Wivinis | 72/705 |
| 4,116,035 | 9/1978 | Malarsky | 72/705 |
| 4,235,090 | 11/1980 | Wightman et al. | 72/705 |

*Primary Examiner*—Lowell A. Larson
*Attorney, Agent, or Firm*—Alan Ruderman

[57] ABSTRACT

A tool for straightening indentations in sheet metal has a pair of levers each having first and second legs disposed angularly to one another and a pivot pin for journally mounting the levers together for pivotable movement about the pin. The levers may be pivoted from a position in which the axes of the first legs are superposed upon each other for insertion of both first legs simultaneously into a hole formed in the sheet metal for receiving the legs. The levers may then be pivoted to a second position in which the first legs face in opposite directions from the pivot pin and engage the sheet metal about the hole. In one embodiment the axes of the second legs in the second position are disposed angularly to one another and a spreader member is removably secured to the legs. A clevis member being secured to the spreader member for application of a pulling force. In two other embodiments the axes of the second legs are superposed upon each other and a clevis member is directly removably secured to both legs.

9 Claims, 6 Drawing Figures

AUTOMOBILE BODY DENT PULLER

BACKGROUND OF THE INVENTION

This invention relates to a sheet metal working tool and more particularly to a method and apparatus for pulling out dents from automobile sheet metal bodies.

In the art of automotive body repairing where access is readily available to only one side of the damaged sheet metal it is difficult with conventional tools to pull out an indentation. The mechanic, in such cases where a mallet and a hand-held anvil cannot be utilized, must use a tool that pulls from the blind side. Conventionally the tool comprises a screw member at one end of a rod having a gripping handle at the other end with a slide hammer in between. A number of holes are drilled into the dented area of the sheet metal body and the screw member is threaded in turn into each of the holes and the hammer is forcibly moved along the rod into engagement with a stop adjacent the handle. The process is repeated for each hole until the dented area conforms to the overall contour of the body, at which time the holes are sealed with body putty.

One difficulty with tools of the aforementioned type is that the area around each hole is upset and jaggered sheet metal projects outwardly about the periphery of each hole thereby requiring excessive grinding. Another difficulty is that excessive pulling may stretch the body locally resulting in mechanical weakness or even cracks extending through the dented area which must be carefully ground and filled.

It is also known in the prior art to use dent pullers having a hook at the free end for insertion within predrilled holes so as to eliminate upsetting of the metal about the hole. Tools of this character are illustrated in U.S. Pat. Nos. 2,900,853 and 3,100,336. In U.S. Pat. No. 3,222,915 a hollow expandable tip is inserted into a hole in the dent and the tip expands when a pulling force is exerted on a rod having a flared end and disposed concentrically within the tip, and which operates similar to tube expanders of the type illustrated in U.S. Pat. No. 3,236,104. In U.S. Pat. No. 3,765,220 a dent puller in the form of a fork-member is used in conjunction with anchor members secured at a number of locations within the dent, the anchors being pulled by the fork-member.

In each of the known prior art devices difficulties are encountered when dents, and especially large dents, are to be repaired. In the hook type tools the pulling force is concentrated on one side and thus tends to result in pivoting of the hook such that the end thereof excessively strains the metal against which it engages. In the known expanding type pullers the expansion is limited and thus they act to pull a limited area. This is also true of the anchor and hook type puller which, since it requires securement of the anchors to the dent, evolves a time consuming process.

SUMMARY OF THE INVENTION

Consequently it is a primary object of the present invention to provide a sheet metal dent puller that can operate from the blind side and apply a pulling load over a relatively large area of a dent.

It is another object of the present invention to provide a sheet metal dent pulling tool which can apply a balanced pulling load on the sheet metal across an opening formed in the dent.

It is another object of the present invention to provide a dent pulling tool having a pair of levers pivotably joined together at the intersection of a pair of legs and adapted such that a corresponding leg of each lever may be pivoted from a superposed disposition to a disposition facing substantially oppositely to each other, and means for applying a pulling force to the other of the legs of each lever.

In accordance with the present invention the sheet metal indentation straightening tool comprises a pair of levers each having first and second legs angularly disposed one to the other, the two levers being pivotably connected together at the junction of the legs so the levers may be pivoted from a position where the axis of the first leg of one lever is superposed upon the axis of the corresponding leg of the other lever for insertion of both first legs into a hole formed in the dent, to another position where the axes of the first legs have been pivoted away from each other to allow the first leg of the levers to extend in opposite directions and engage the sheet metal across the hole, the second legs having means for receiving a pulling force. Thus, although the diameter of the hole need be no larger than the width of each first leg, the first legs can engage sheet metal along a length substantially equal to the sum of the lengths of the first legs from the pivot point. Where the first legs are of the same length they can engage sheet metal along a length twice that of their length from the pivot point. In the preferred form of the tool the levers are identical but mounted reversely one upon the other.

In one embodiment of the present invention the axes of the respective first and second legs are disposed at an obtuse angle to one another and each second leg is secured to a spreader plate after the first legs have been rotated into operative disposition for engagement with the sheet metal, and a pulling member is secured to the spreader plate. In an other embodiment the axes of the respective first and second legs are substantially normal to one another and the second legs are together secured to a pulling member. In a third embodiment the axes of the second legs are at an angle to the axes of the first legs but are substantially normal to the metal engaging surface of the respective first legs.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
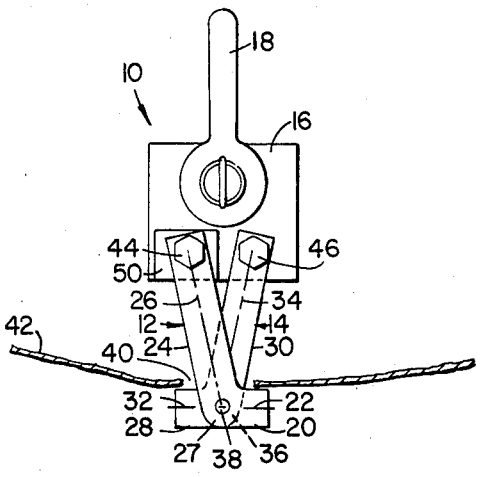
FIG. 1 is a front elevational view of one form of a dent straightening tool constructed in accordance with the principles of the present invention in the operative pulling position within a hole formed in a dented portion of a sheet metal body, the latter being illustrated in cross section.
Figure 2:
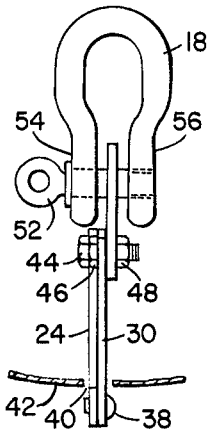
FIG. 2 is a side elevational view of the tool illustrated in FIG. 1.
Figure 3:
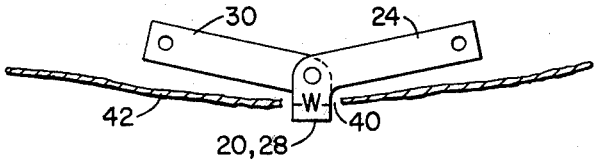
FIG. 3 is a front elevational view of the lever members of the tool in the hole insertion position as they are being inserted into a hole in the dent prior to being pivoted to the pulling position.

Referring now to the drawings and particularly to the embodiment in FIGS. 1 through 3, the tool shown therein is illustrated generally at 10 and comprises a pair of pivotably journalled rigid metal levers 12 and 14 removably secured to a spreader plate 16, to which a clevis 18 or similar handle or gripping device may be attached. Each lever 12,14 comprises a pair of planar legs disposed angularly one to the other. For example, the lever 12 comprises a first leg 20 having a substantially centrally disposed axis of elongation 22 and a second leg 24 having a centrally disposed elongated axis 26, the axes 22 and 26 being at an obtuse angle and intersecting within an elbow 27 at the junction of the legs. Similarly, the lever 14 which is identical to the lever 12 includes a first leg 28 and a second leg 30, each having a respective axes 32 and 34 intersecting within an elbow 36.

At the intersection of each respective pair of axes a pivot pin in the form of a rivot 38 or similar connecting journal is received within apertures formed in the elbow, and the levers are pivotably connected together, the disposition of one lever being inversed relatively to the other so that when the axes 26 and 34 of the respective legs 24 and 30 are superposed one on the other, the axes 22 and 32 are not superposed on each other and legs 20 and 28 extend in different directions from the pivot pin 38 away from each other, and when the axes 22 and 32 of respective legs 20 and 32 are superposed upon each other as illustrated in FIG. 3, the axes 26 and 34 are not, and the legs 24 and 30 extend in directions away from each other. In the embodiment illustrated in FIG. 1, since the respective first and second legs are at an obtuse angle to one an other, the axes 26 and 34 of legs 24 and 30 respectively make an acute angle therebetween when the axes 22 and 32 are substantially coincident.

The construction of the lever as described is such that the levers can be pivoted relatively to each other from a position wherein the legs 20 and 28 overlay each other and the total width W of these legs as illustrated in FIG. 3 is equal to the width of one of the legs. Thus, both legs 20,28 may be inserted into a hole having a diameter substantially equal to the width W, but slightly larger to accomodate the thickness of the legs. As presently anticipated this dimension will be approximately one half inch. A hole of this diameter may be drilled or otherwise formed within a dent in the sheet metal 42 of an automobile body or the like and the legs 20,28 inserted. The levers may then be pivoted about pin 38 to the position illustrated in FIG. 1 for engaging the sheet metal inside the body.

Each leg 24 and 30 at the upper end thereof includes an aperture for receiving a respective bolt 44,46 for attaching the levers to the spreader plate 16, and a respective nut 48 (only one of which is illustrated) secures the levers. A small spacer plate 50 may be placed between the outer lever 24 and the spreader plate 16 before placement of the bolt 44 to prevent bending of the lever and to provide a more rigid securement. Substantially centrally disposed between and above the attachment locations of the levers on the spreader plate, the spreader plate has an aperture for receiving an attachment member such as thumbscrew 52 which extends through one leg 54 of the clevis 18 into and through the spreader plate 16 and is thereby received in the second leg 56 of the clevis. The clevis can be gripped and pulled by a workman or a power pulling device may be hooked thereto to apply a pulling force which is transmitted to the levers. Consequently the pulling force is applied by the legs 20 and 28 to the inside of the sheet metal to pull out the dent.

It should be understood that the force applied by the lever legs on the sheet metal may be spread on opposite sides of the hole 40 effectively along an extension of the diameter thereof. The legs 20 and 28 may have a length sufficiently large to apply the force over a large area of the sheet metal and thereby preclude localized strains about the vicinity of the hole. The length of the legs possible is limited only where a body structural or a double wall feature is located behind the hole in the dented area.

Figure 4:
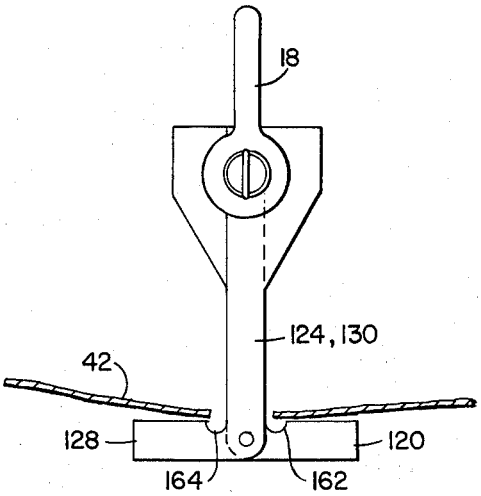
FIG. 4 is a view similar to FIG. 1, but of a second embodiment of the tool.
Figure 5:
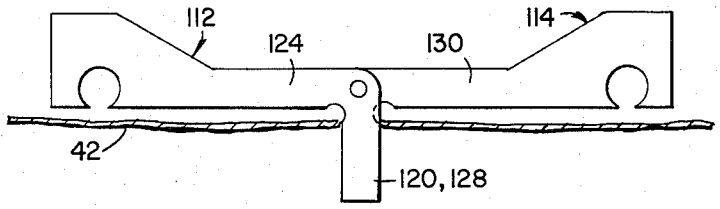
FIG. 5 is a view similar to FIG. 3, but of the tool illustrated in FIG. 4.

In the embodiment illustrated in FIGS. 4 and 5 the levers 112 and 114 have respective first and second legs 120,124 and 128,130 that are substantially at right angles to each other so that the legs 124,130 may be superposed one on the other when the legs 120,128 are in the operative position behind the sheet metal. Thus, the spreader plate may be eliminated and the levers may be attached directly to the clevis 18 between the legs thereof. In this case, however, the angular disposition of the legs is limiting when the dent is large and deep since the legs 120,128 may have to be angularly spaced and the hole may have to be of a diameter larger than the width of each of the legs. To reduce this limitation the legs 120,128 may have a notch 162,164 respectively formed at the work engaging surface of the junction of the respective leg 124,130. This allows the legs 120,138 to be inserted in superposed position and be thereafter rotated without first engaging the legs 124,130 against the outside of the sheet metal.

Figure 6:
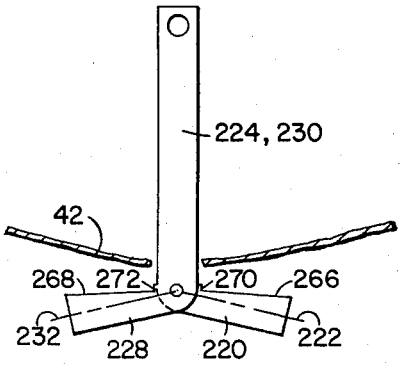
FIG. 6 is a view similar to FIG. 1, but of a modification thereof.

In the third form as illustrated in FIG. 6, the obtuse angular disposition between the first and second legs may be obtained while providing the advantage of elimination of the spreader plate. Thus the axes 222 and 232 of the respective first legs 220,228 are at an obtuse angle to the axes of the legs 224,230 but the metal engaging surfaces 266,268 are disposed angularly to the respective axis 222,232. Thus the surfaces 266,268 may engage the sheet metal within the dent while the legs 224,230 are superposed upon each other. The surfaces 266,268 may commence from respective surfaces 270,272 disposed relatively to the pivot pin substantially one half the diameter of the drilled hole.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A tool for straightening indentations in sheet metal comprising, a pair of rigid levers, each lever having a first leg elongated along a first axis and a second leg elongated along a second axis disposed angularly to the respective first axis, means for pivotably mounting said levers one to the other substantially at the junction of the first and second axes, the disposition of one lever relatively to the other lever being such that said levers when pivotable to a first position wherein said first axes are superposed substantially upon one another said second axes are disposed angularly to one another whereby both of said first legs only may be inserted into a hole formed in the sheet metal for receiving said first legs, said levers being pivotable from said first position to a second position wherein said first axes are disposed angularly one to the other and said first legs are restrained from exiting from the hole and engage the sheet metal across said hole, and means for grasping both of said second legs in said second position, whereby a pulling force may be applied to said second legs for impact engagement of said first legs with the sheet metal.

2. A tool as recited in claim 1, wherein said first axis of each lever is disposed at an obtuse angle to the respective second axis.

3. A tool as recited in claim 1, wherein said first axis of each lever is disposed at a right angle to the respective second axis.

4. A tool as recited in claim 2, wherein said means for grasping said second legs comprises a spreader member, means for removably securing both said second legs to said spreader member, and a grasping member secured to said spreader member.

5. A tool as recited in claim 4 wherein, said first axes of said levers are substantially coincident when said second legs are secured to said spreader member.

6. A tool as recited in claim 4 including, a spacer member mounted intermediate said spreader member and one of said second legs.

7. A tool as recited in claim 1 wherein, the second axis of one lever is superposed substantially upon the second axis of the other lever when in said second position, and said first leg includes a sheet metal engaging surface substantially normal to said second axes.

8. A tool as recited in claim 7 wherein, said first axes are disposed substantially at right angles to said second axes in said second position.

9. A tool as recited in claim 7 wherein, said means for grasping said second legs comprises a grasping member, and means for removably securing said grasping member concurrently to both of said second legs.

* * * * *